US005380219A

United States Patent [19]

Klier

[11] Patent Number: 5,380,219

[45] Date of Patent: Jan. 10, 1995

[54] CABLE PLUG CONNECTOR AND CABLE BUSHING

[76] Inventor: Jurgen Klier, Am Herrnacker 9, 6072 Dreieich, Germany

[21] Appl. No.: 9,603

[22] Filed: Jan. 27, 1993

[30] Foreign Application Priority Data

Jan. 27, 1992 [DE] Germany ..... 4202176

[51] Int. Cl.[6] ..... H01R 13/56

[52] U.S. Cl. ..... 439/446

[58] Field of Search ..... 439/446, 610, 6, 8

[56] References Cited

U.S. PATENT DOCUMENTS

| | | | |
|---|---|---|---|
| 4,111,513 | 9/1978 | Thurston et al. | 439/610 |
| 4,190,307 | 2/1980 | Eckaart | 439/10 |

FOREIGN PATENT DOCUMENTS

| | | | |
|---|---|---|---|
| 2266330 | 10/1975 | France | 439/446 |
| 2623145 | 12/1977 | Germany . | |
| 2737013 | 3/1979 | Germany . | |
| 3135781 | 9/1981 | Germany . | |
| 299176 | 10/1928 | United Kingdom | 439/446 |
| 2085242 | 4/1982 | United Kingdom . | |
| 959196 | 9/1982 | U.S.S.R. | 439/446 |

*Primary Examiner*—Gary F. Paumen
*Attorney, Agent, or Firm*—Dena Meyer Weker

[57] ABSTRACT

Cable plug connectors and cable bushings with freely selectable cable outlet directions comprising a housing which includes a cable outlet area and/or a reinforced opening area and a contact area wherein the cable outlet area is provided with a ball joint through which a cable which is connected with the contact area can be guided.

14 Claims, 8 Drawing Sheets

CABLE PLUG CONNECTOR AND CABLE BUSHING

FIELD OF THE INVENTION

A high frequency-proof cable plug connector is provided having a housing which incorporates a cable outlet area with a ball joint through which a cable with a plug element is guided.

BACKGROUND OF THE INVENTION

In many fields of industrial electronics, in particular avionics, it is necessary to use high-frequency proof cable plug connectors or cable bushings whose cable outlet directions are adapted to special design and shape requirements of the particular environment where the connector is used, such as in an aircraft fuselage. For this purpose, plug backshells have been developed with heat-shrinkable moldings which are supplied in an elastic form and which are slipped over pre-assembled plugs. When exposed to heat, the intended end shape is imparted to the plugs. One end encloses the rear part of the plug, the other end firmly shrinks onto the cable. In its warm and elastic state the cable outlet can be bent within a narrow angle around the pre-determined end shape into a different angle which it keeps after cooling off. The shortcoming of such backshells consisting of heat-shrinkable plastic material is, however, that they are commercially available in certain designs only, mainly with angles of 90° and 180° and that the cable outlet angle varies within a large tolerance range after heat shrinking. It is very expensive to produce a wide variety of different cable outlet angles using these backshells. Furthermore, it is not possible to subsequently change the angle such as at the installation site of the plug connector.

Furthermore, there are conventional housings for cable plug connectors which are produced by metal die casting or plastic injection molding. Their cable outlet openings are defined by the housing shape. For different applications, again, a cost-intensive wide variety of different shapes has to be provided and it is not possible to change the angle.

The published application DE 3135781 discloses a cable plus connector with two selectable cable outlet directions and a housing which is provided with a cable inlet area and a contact area. The housing consists of two parts which can be separated and joined, preferably manually, in the cable inlet area. The separable surfaces extend diagonally to the longitudinal axis of the plug connector. These plug connectors facilitate a cost-saving mass production and provide for an easy method of producing the desired cable outlet opening at the site of installation. However, for many applications in industrial electronics, they are not suitable because only two cable outlet directions (0° and 90°) can be set.

There is a need for a cable plug connector and a cable bushing with a freely adjustable cable outlet opening whose cable outlet angle can be adjusted within a given tolerance freely and very accurately, which excel by their high-frequency proofness and which can be easily adjusted at the site of installation.

SUMMARY OF THE INVENTION

A cable plug connector in a housing is provided with a basic plug element and a cable outlet area, wherein the cable outlet area is equipped with a ball joint through which a cable connected to the plug element is guided.

A cable bushing with a housing is also provided with a reinforced opening area and a cable outlet area. The cable outlet area is provided with a ball joint through which a cable can be guided. In a preferred embodiment, the ball joint is designed such that it can be freely adjusted in a first assembly state. Since the cable can be guided through the ball joint, the cable outlet angle can be adjusted in this assembly state through the adjustable ball joint. In a second assembly state, the ball joint is securely fixed. Once defined and precisely adjusted, the cable outlet angle then stays fixed. For maintenance work and the like, the joint can be returned to the first assembly state where it can be readjusted. The two assembly states of the ball joint may be reached by tightening or loosening a screw connection or the like in order to increase or decrease the contact pressure to which a ball joint is subjected when it sits between a ball joint pan and a ball joint cap element.

In a particularly preferred embodiment, the housing of a cable plug connector or a cable bushing and all components of the ball bearing are made from an electrically conductive material and are electrically connected with the shield of the cable guided through the ball joint in order to ensure a high frequency resistance.

DETAILED DESCRIPTION OF THE PREFERRED EMBODIMENTS

The invention is best understood by reference to the accompanying drawings.

Figure 1:
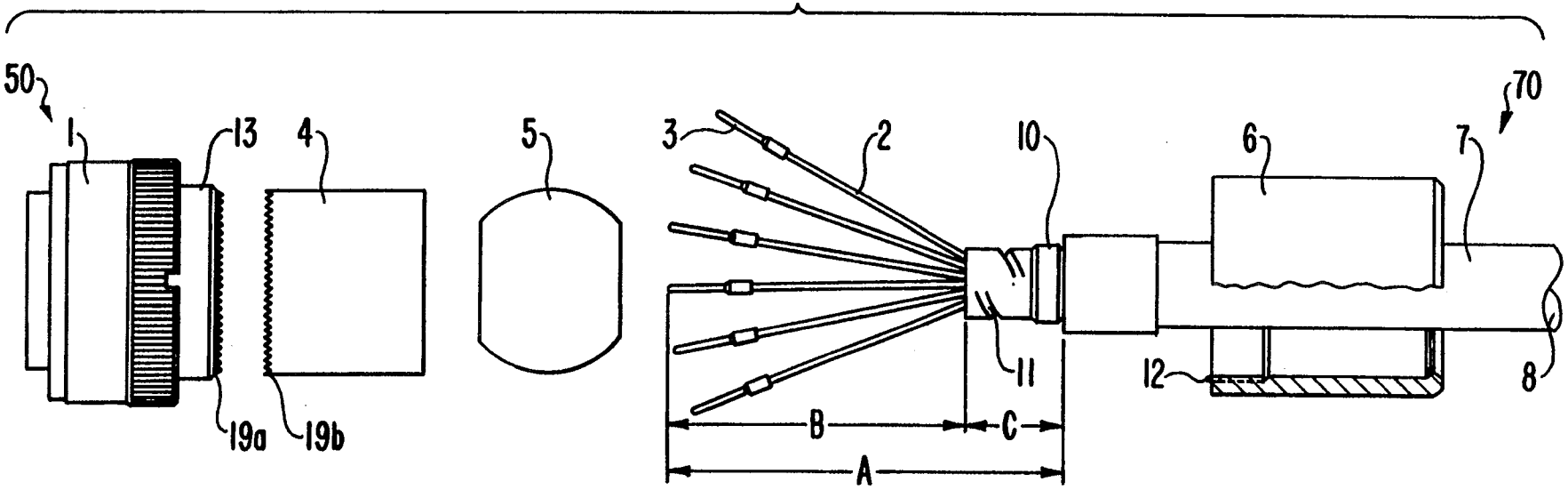
FIG. 1 shows an explosion view of a cable plug connector according to the present invention with freely adjustable cable outlet direction.

FIG. 1 is an exploded view of a cable plug connector with freely adjustable cable outlet directions. The cable plug connector is provided with a basic plug element 1 which is equipped with suitable recesses to accommodate contact pins or contact bushings 3 mounted to cable conductors 2. The end of the cable plug connector which faces a matching plug counter-piece is designated as "proximal" in the following and is designated as location 50; the opposite end as "distal" and is designated as location 70. This nomenclature will also be applied to the positions of other components of the cable plug connector. The proximal end of the basic plug element 1 is geometrically shaped in such a way that it functionally interacts with a corresponding counter-piece of a plug. The basic plug element 1 is preferably designed as a standard part so that it can be used as a component in the standard plug connection common for a specific application.

A ball joint is arranged on the distal end of the basic plug element 1. This ball joint consists of a ball joint pan ring 4, a ball joint body 5 and a ball joint screw cap 6. A shielded cable 7 comprising a number of cable conductors 2 is guided through said ball joint.

Figure 2:
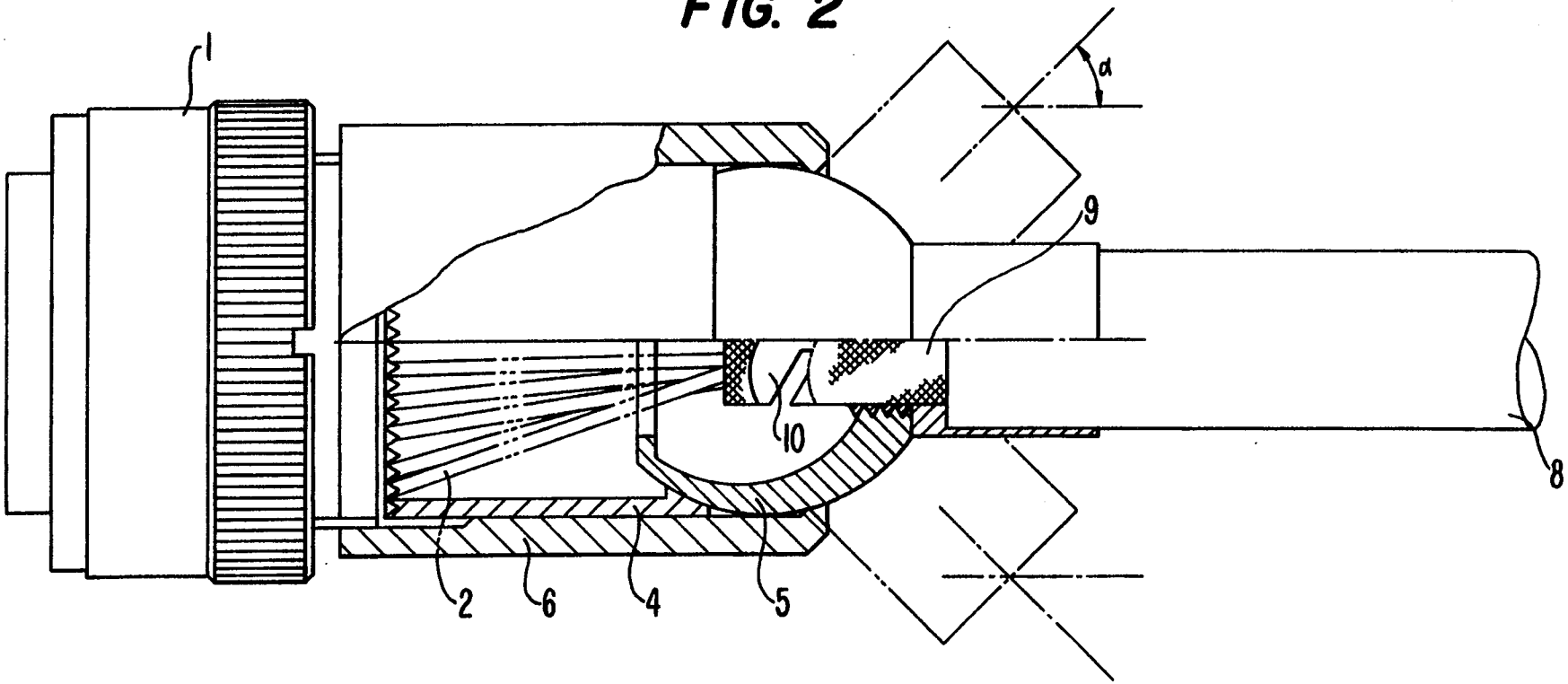
FIG. 2 shows a top view onto a cable plug connector of FIG. 1 according to the present invention, partly cut open.

The shielded cable 7 is provided with an insulating jacket 8, which extends from the distal cable end up to a spot located at a predetermined distance A from the contact pins or bushings 3. The shielded cable 7 is provided with an electrically conductive braided shield 9 under the insulating jacket 8, as shown in FIG. 2. The braided metal shield 9 extends from the distal cable end up to a spot located at a predetermined distance B from the contact pins 3. The distance C between the proximal end of the insulating jacket 8 and the proximal end of the braided shield 9 is a cable section where the braided shield 9 of the cable 7 is exposed and in electrical contact with a cable guiding sleeve 10 consisting of an electrically conductive material. In a preferred embodiment, the cable guiding sleeve 10 comprises soldering grooves 11 which are spirally cut into the circumference of a section located at the proximal end and by means of which the cable guiding sleeve 10 is soldered to the braided shield 9. The proximal end of the screw cap 6 covering the ball joint is provided with an inner thread 12 to which an outer thread 13 on the distal end of the basic plug element is screwed. In this way the ball joint body 5 is clamped between the ball joint pan ring 4 and the screw cap 6 covering the ball joint with an adequate pressure, which, by loosening or tightening the screwed connection can be decreased for adjustment or increased for final fixation.

FIG. 2 is a top view (partly cut open) of a cable plug connector designed according to the invention and the first embodiment shown in FIG. 1. The cable guiding sleeve 10 extends longitudinally so that the cable outlet direction is freely selectable within a cone, which is symmetrical to the longitudinal axis of the plug and which has an opening angle of about 90°. This allows for the cable outlet direction to be adjusted in all directions by up to approximately $\alpha = \pm 45°$.

Figure 3:
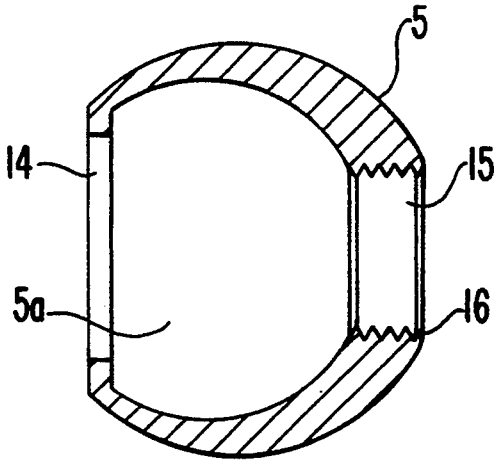
FIG. 3 shows a cross-section through a ball joint body of the cable plug connector of the present invention as shown in FIG. 1.

FIG. 3 is a cross-section through a ball joint body 5 of the cable plug connector described in the present invention, according to FIG. 1. In order to minimize the total weight of the cable plug connector described in the invention and to impart desirable elastic properties to the ball joint body 5, it is provided with a cavity 5*a* with a proximal opening 14 and a distal opening 15. The distal opening 15 is preferably equipped with an inner thread 16 which the cable guiding sleeve 10, which is provided with a matching outer thread at a distal section is screwed.

Figure 4:
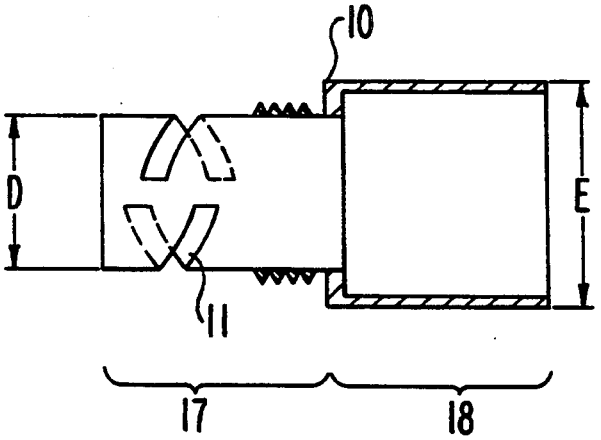
FIG. 4 shows a cross-section through a cable guiding sleeve of the cable plug connector of the present invention as shown in FIG. 1.

FIG. 4 is a cross-section through a cable guiding sleeve 10 of a first embodiment of the cable plug connector shown in FIG. 1. In a preferred embodiment, said cable sleeve 10 is provided with a proximal section 17 of a first diameter D and a distal section 18 arranged subsequently to the latter, with a second diameter E, wherein the first diameter D is smaller than the second diameter E. The distal section 18 may be provided with an inner thread to which the cable 7 may be screwed with its insulating jacket 8, as a stress relief measure. When a suitable material such as a soft plastic is used, the inner thread of section 18 may cut the required outer thread into the insulating jacket 8 of the cable 7, when screwing the parts together.

Figure 5:
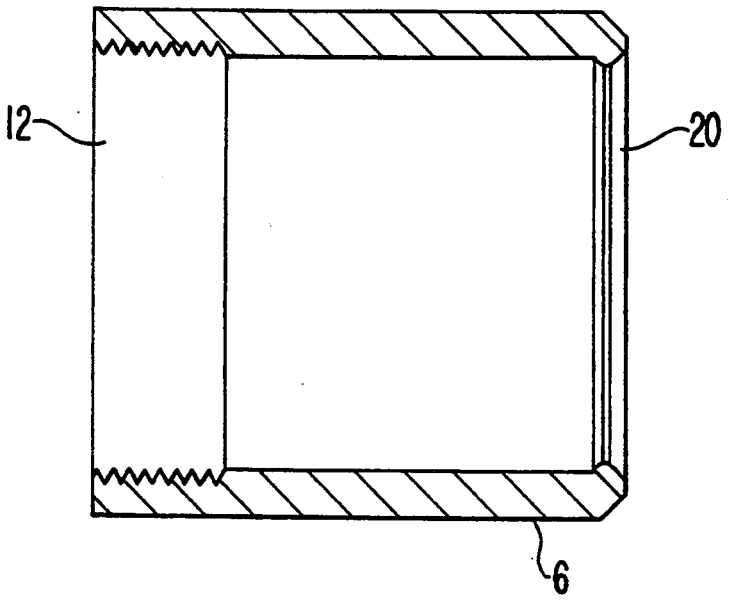
FIG. 5 shows a cross-section through a screwed cap on a ball joint of a cable plug connector of the present invention as shown in FIG. 1.

FIG. 5 is a cross-section through the ball joint screw cap 6 of the cable plug connector shown in FIG. 1. This screw cap is basically formed by a cylindrical tubular piece the inner diameter of which is dimensioned such that the ball joint body 5 can be easily inserted into the ball joint screw cap 6. The distal end of the ball joint screw cap 6 is provided with an inner edge 20 whose inner diameter is designed such that the ball joint body 5 cannot leave the distal end of the ball joint screw cap 6.

Figure 6:
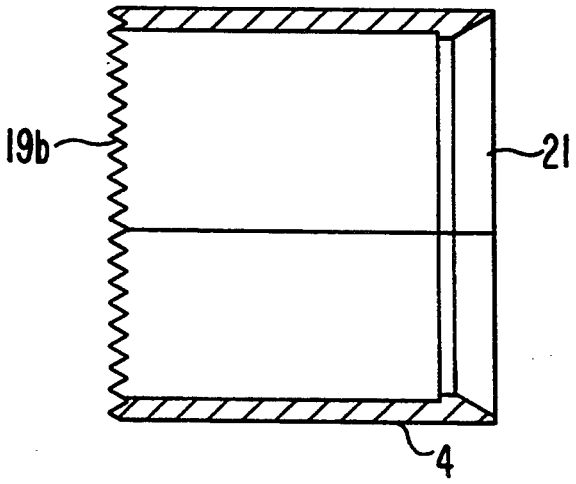
FIG. 6 shows a cross-section through a ball joint pan ring of a cable plug connector according to the present invention.

FIG. 6 is a cross-section through the ball joint pan ring 4 of the cable plug connector shown in FIG. 1. The pan ring 4 basically consists of a tubular section whose inner diameter is designed like a joint pan at the distal end 21 so that in particular the ball joint body 5 with its proximal end cannot pass through the pan ring 4. At its proximal end, the pan ring 4 may be equipped with teeth 19*b* which engage with matching teeth 19*a* on the distal end of the basic plug element 1. In particular when the proximal end of the pan ring 4 is planar, the inner circumference of this end of the pan ring 4 may be provided with a groove of a flattened or polygonal cross-section to avoid radial displacements of the pan ring 4 relative to the basic plug element 1, which might endanger the high-frequency proofness. In a preferred embodiment, the pan ring 4 may incorporate a longitudinal slot over its entire length.

Figure 7:
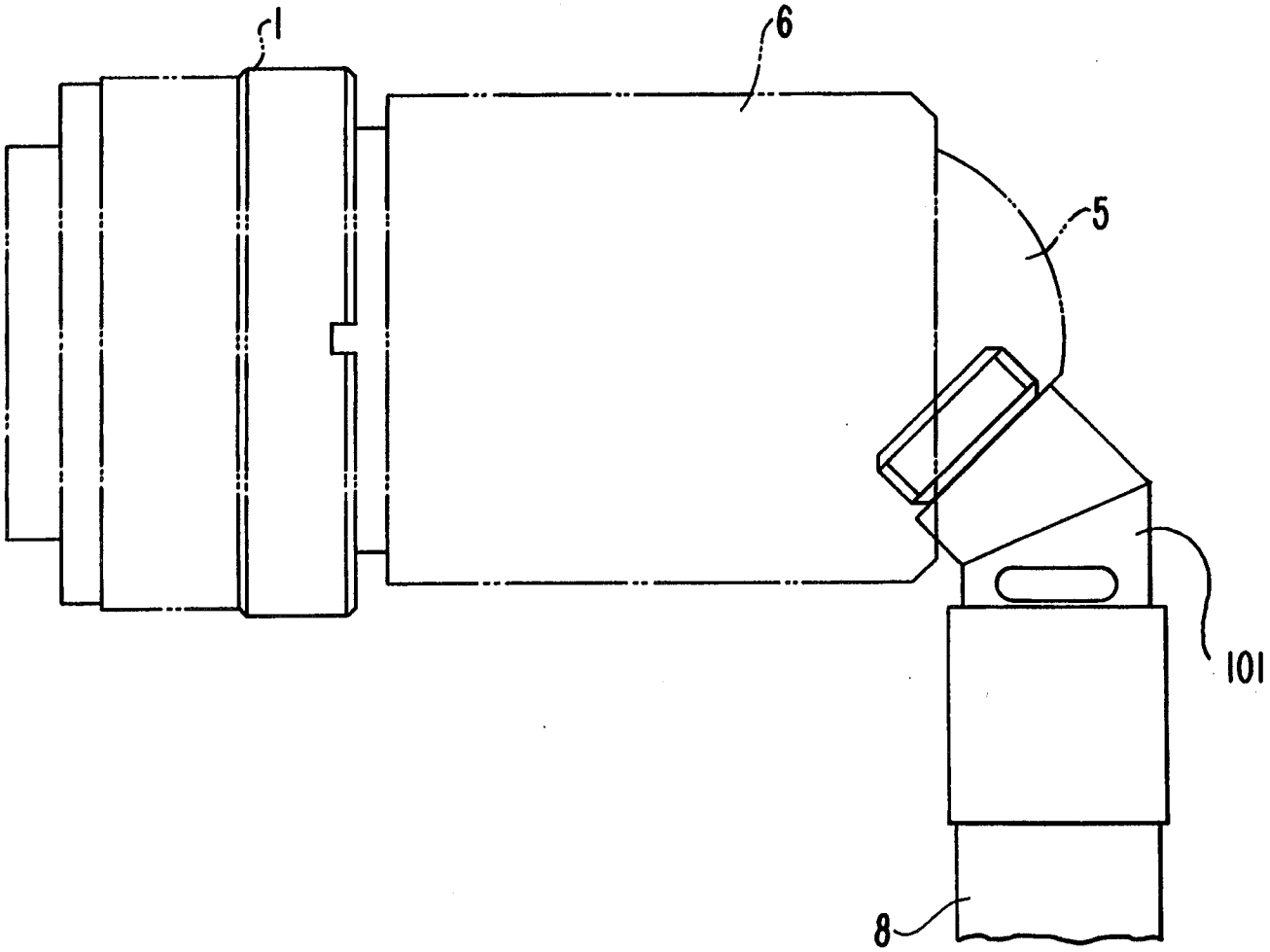
FIG. 7 shows a cross-section through a second embodiment of a cable plug connector according to the present invention.

FIG. 7 is a cross-section through a second embodiment of a cable plug connection according to the invention. In the first embodiment, according to FIG. 1, it is not possible to set the angle between the longitudinal axis of the plug and the cable outlet direction to a value of $\alpha$=more than approximately 45°. In some applications, however it would be extremely desirable to set greater cable outlet angles such as, $\alpha' = 90°$. In a cable plug connector as described herein, this can be achieved by using an angular cable guiding sleeve 101.

Figure 8:
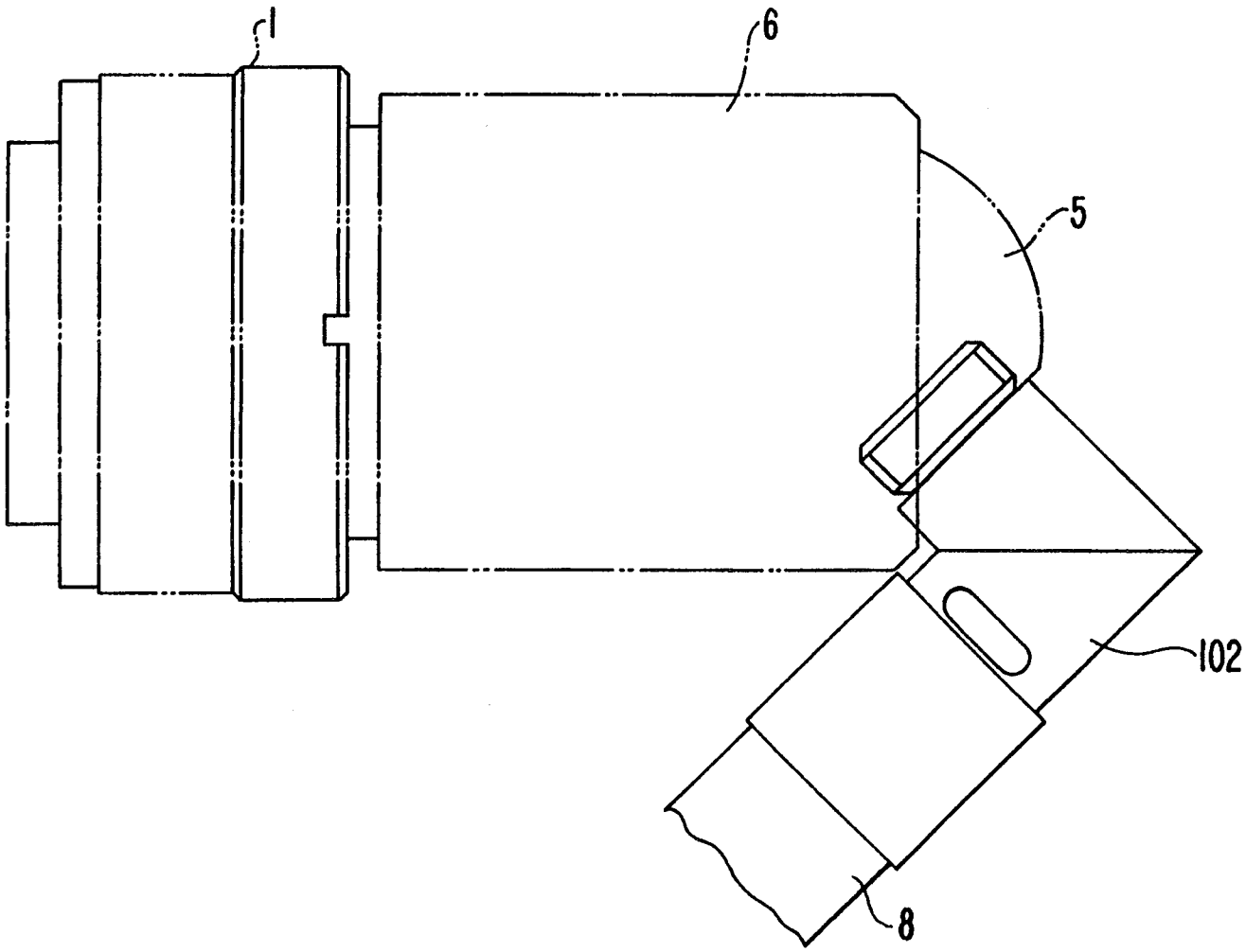
FIG. 8 shows a cross-section through a third embodiment of a cable plug connector according to the present invention.

FIG. 8 is a cross-section through a third embodiment of a cable plug connector in which an even greater angular cable guiding sleeve 102 is used, which allows for cable outlet angles $\alpha''$ of more than 90°.

Figure 9:
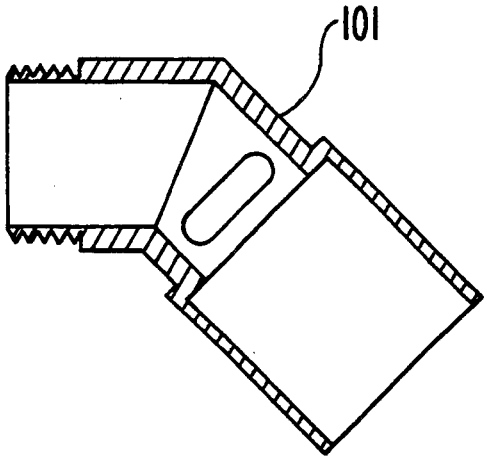
FIG. 9 shows a cross-section through a distal cable guiding sleeve of a cable plug connector according to the invention as shown as the second embodiment in FIG. 7.
Figure 10:
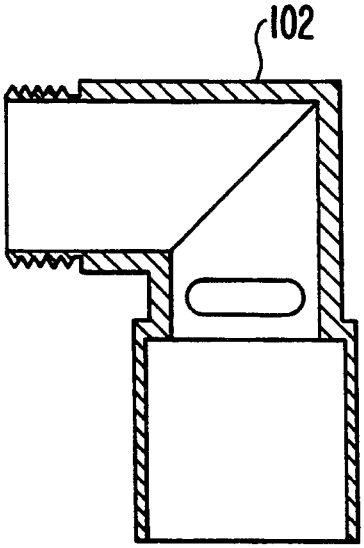
FIG. 10 shows a cross-section through a cable guiding sleeve of a cable guiding sleeve of the cable plug connector according to the invention and as shown as the third embodiment in FIG. 8.

FIG. 9 is a cross-section through a cable outlet sleeve 101 in a cable plug connector of the invention according to the second embodiment, with an angle of more than 45°, whereas FIG. 10 is a cross-section through a cable guiding sleeve 102 with an angle of 90° in a cable plug connector.

Figure 11:
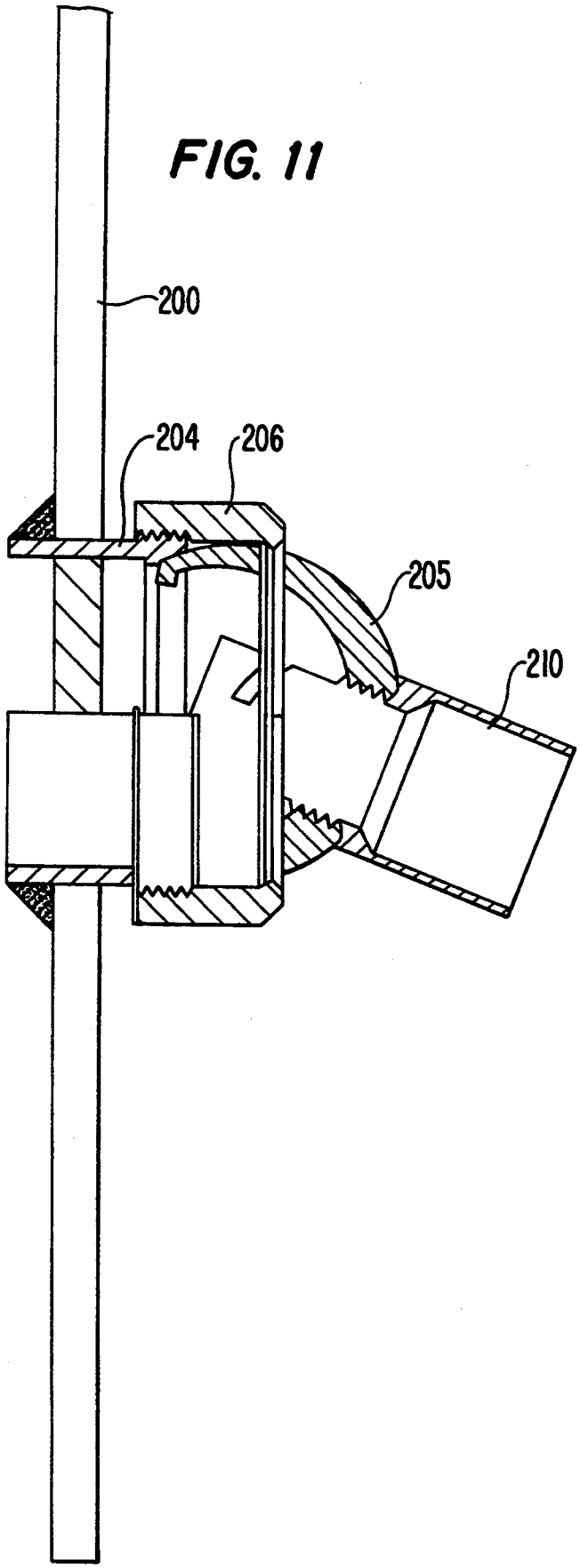
FIG. 11 shows a cross-section through a cable bushing according to the invention.

FIG. 11 is a cross-section through a cable bushing as described herein, wherein the cable outlet direction is freely adjustable. This cable bushing is basically designed like the cable plug connector shown in FIG. 1, the only difference being that the ball joint pan ring 204 is attached to a housing wall 200 with an opening and not to a basic plug element. This embodiment, too, incorporates a ball joint comprising a ball joint pan ring 204, a ball joint body 205 and a ball joint screw cap 206. A cable guiding sleeve 210 is inserted into the ball joint body 205 and a cable can be guided through said sleeve.

I claim:

1. A cable plug connector with a housing comprising a cable outlet area and a basic plug element (1), wherein the cable outlet area is provided with a ball joint (4, 5, 6) through which a cable (7) connected with the plug element (1) is guided, wherein the ball joint (4, 5, 6) is provided with a ball joint pan ring (4), a ball joint body (5) and a ball joint screw cap (6) and wherein the latter is detachably connectable to the plug element (1), and the ball joint body (5) is clamped between the ball joint screw cap element (6) and the ball joint pan ring (4) and wherein the end of the ball joint pan ring (4) facing away from the ball joint body (5) is supported on the plug element (1).

2. A cable plug connector according to claim 1, wherein the cable (7) with a cable guiding sleeve (10) attached to the ball joint body (5) is guided through the ball joint (4, 5, 6).

3. A cable plug connector according to claim 1, wherein the ball joint pan ring (4) is provided with a slot over its entire length.

4. A cable plug connector according to claim 1, wherein the plug element (1) and the ball joint pan ring (4) are each provided with matching teeth (19*a*, 19*b*) at their contact ends.

5. A cable plug connector according to claim 1, wherein a proximal end of the ball joint pan ring (4) is provided with a groove around its inner circumference.

6. A cable plug connector according to claim 1, wherein the cable (7) is provided with a conductive shield cover (9) which is exposed in the area of the cable guiding sleeve (10) and the cable guiding sleeve (10) is provided with one or several soldering grooves (11) and wherein the soldering grooves (11) are filled with soldering tin which solders the cable guiding sleeve (10) to the shield cover (9).

7. A cable plug device according to claim 2, wherein the cable guiding sleeve (10) can be rotated at an angle.

8. A cable plug connector according to claim 1, wherein the ball joint (4, 5, 6) consists of an electrically conductive material.

9. A cable guiding device for guiding an electrical cable through a wall (200) with an opening comprising a housing which incorporates a cable outlet area and a reinforcing area for the opening, wherein the cable outlet area is provided with a ball joint (204, 205, 206) through which a cable can be guided, wherein the ball joint (204, 205, 206) is provided with a ball joint pan ring (204), a ball joint body (205) and a ball joint screw cap (206), and wherein the latter can be detachably connected to the wall (200); the ball joint body (205) can be clamped between the ball joint screw cap (206) and the ball joint pan ring (204) and wherein the end of the ball joint pan ring (204) facing away from the ball joint body (205) is supported on the wall (200).

10. A cable guiding device according to claim 9, wherein the cable is guided through the ball joint (204, 204, 206) with a cable guiding sleeve (210) attached to the ball joint body (205).

11. A cable guiding device according to claim 9 wherein the ball joint pan ring (204) is provided with a slot over its entire length.

12. A cable guiding device according to claim 9, wherein the cable is provided with a conductive shield which is exposed in the area of the cable guiding sleeve (210) and wherein the cable guiding sleeve (210) is provided with one or several soldering grooves which are filled with soldering tin which solders the cable guiding sleeve (210) to the shield cover.

13. A cable guiding device according to claim 9, wherein the cable guiding sleeve (210) can be rotated at an angle.

14. A cable guiding device according to claim 9, wherein the ball joint (204, 205, 206) consists of an electrically conductive material.

* * * * *